US006515420B2

(12) United States Patent
Chen et al.

(10) Patent No.: US 6,515,420 B2
(45) Date of Patent: Feb. 4, 2003

(54) FULL-COLOR PLASMA DISPLAY PANEL USING DIFFERENT DISCHARGE GASES TO EMIT LIGHTS

(75) Inventors: Po-Cheng Chen, Taipei Hsien (TW); Jiun-Han Wu, Taipei Hsien (TW); Chien-Hsing Li, Tai-Chung (TW)

(73) Assignee: AU Optronics Corp., Hsinchu (TW)

( * ) Notice: Subject to any disclaimer, the term of this patent is extended or adjusted under 35 U.S.C. 154(b) by 6 days.

(21) Appl. No.: 09/682,405

(22) Filed: Aug. 30, 2001

(65) Prior Publication Data

US 2002/0050787 A1 May 2, 2002

(30) Foreign Application Priority Data

Nov. 2, 2000 (TW) ..... 089123058

(51) Int. Cl.[7] ..... H01J 17/49

(52) U.S. Cl. ..... 313/582; 313/493

(58) Field of Search ..... 313/582, 493, 313/519, 639

*Primary Examiner*—Vip Patel
(74) *Attorney, Agent, or Firm*—Winston Hsu

(57) ABSTRACT

A plasma display panel(PDP) is disclosed. The PDP includes a rear plate, a front plate spaced apart and positioned in parallel with the rear plate, and a plurality of barrier ribs positioned in the space between the rear plate and the front plate to define a plurality of discharge space groups. Each discharge space group includes a first discharge space, a second discharge space, and a third discharge space. Each discharge space is filled with the different discharge gases including a first, a second, and a third discharge gas for respectively emitting of one of three primary colors. The rear plate of the PDP has a reflecting layer to reflect the light and prevent the light from penetrating through the rear plate so as to increase the luminescent efficiency of the PDP.

12 Claims, 8 Drawing Sheets

FULL-COLOR PLASMA DISPLAY PANEL USING DIFFERENT DISCHARGE GASES TO EMIT LIGHTS

BACKGROUND OF INVENTION

1. Field of the Invention

The present invention relates to a full-color plasma display panel, and more particularly, to a plasma display panel using different discharge gases to emit variant colors of light.

2. Description of the Prior Art

A full-color plasma display panel (PDP) is a common type of flat display that uses discharge gases to emit multi-color lights. The luminescent performance of the PDP is made by the millions of tiny discharge cells for emitting fluorescent lights of various colors. The prior PDP includes phosphor materials coated in these tiny discharge cells. The dimensions of these cells can be in the order of a few hundred microns. Each of the cells is filled with a discharge gas of a mixture of neon (Ne) and xenon (Xe), or a mixture of helium (He) and xenon (Xe). When the plasma is excited, the discharge gas emits ultraviolet light and the ultraviolet light in turn irradiates the phosphor materials to result in the emission of red, green or blue light.

Please refer to FIG. 1. FIG. 1 is a perspective view of a full-color PDP 10 according to the prior art. The prior PDP 10 includes a first substrate 12, a second substrate 14 parallel to the first substrate 12, and a discharge gas (not shown) that fills the space between the first substrate 12 and the second substrate 14. The prior PDP 10 further includes a plurality of first electrodes 18, a plurality of second electrodes 20, and a plurality of third electrodes 22. The first electrodes 18 and the second electrodes 20 are positioned in parallel and spaced apart to each other by a fixed distance on the first substrate 12. Each of the third electrodes 22 is positioned on the second substrate 14, and is perpendicular to both the first electrodes 18 and the second electrodes 20. Each of the first electrodes 18 and the second electrodes 20 includes a maintaining electrode 181, 201, and an auxiliary electrode 182, 202, respectively. The maintaining electrodes 181, 201 are made of ITO materials, and the auxiliary electrodes 182, 202 are made of a Cr/Cu/Cr metal alloy. The maintaining electrodes 181, 201 have high resistance and poor conductivity, but are transparent to visible light. The auxiliary electrodes 182, 202 have low resistance to increase the conductivity of its respective electrode 18, 20.

The PDP 10 further includes a dielectric layer 24 covering the surfaces of the first substrate 12, the first electrodes 18, and the second electrodes 20. A protective layer 26 covers the dielectric layer 24. A plurality of barrier ribs 28 are positioned in parallel on the second substrate 14 to define a plurality of discharge spaces 30 of strip shape. Each third electrode 22 is positioned between two adjacent barrier ribs 28. A phosphor layer 32 covers the third electrode 22 and the barrier rib 28 within each discharge space 30 in order to produce red, green, or blue light.

Each of the discharge spaces 30 has a plurality of display units 34. Each display unit is defined by one first electrodes 18, one second electrodes 20, and one third electrodes 22. When an initiating voltage is applied on the first electrode 18 and the third electrode 22, the discharge gas between the first electrode 18 and the third electrode 22 is ionized to form charges on the walls. Both the first electrode 18 and the second electrode 20 are used to drive the plasma formed in these display units 34 for causing a continuous emission of ultraviolet light. Under the ultraviolet light, the phosphor layer 32 emits lights which are transmitted through the transparent first substrate 12 and seen by the user.

The color of lights emitted from the phosphor layer 32 have different colors according to the phosphor materials. Usually, red light is emitted by the phosphor layer 32 when the material of the phosphor layer 32 has $((Y,Gd)BO_3)$, and Eu is added as an activating agent. The green light is emitted when the material of the phosphor layer 32 has $Zn_2SO_4$, and Mn is added as an activating agent. Finally, the blue light is emitted when the material of the phosphor layer 32 has $BaMgAl_{14}O_{23}$, and Eu is added as an activating agent.

However, the manufacturing method of the phosphor materials is complicated, and the costs of these materials are not cheap. The purity of the red light emitted from the phosphor layer 32 is poor, some remaining images will be produced by the green light, and the blue light will be degraded easily. Further, the phosphor layer 32 coated within the discharge space 30 is easily damaged by plasma bombardment, which shortens the life of the PDP 10.

SUMMARY OF INVENTION

It is therefore a primary objective of the present invention to provide a full-color PDP that uses different discharge gases to emit variant colors of light. At the same time, a reflecting layer is used to reflect the light emitted by each discharge gas to prevent the light emitting through the rear plate so as to increase the luminescent efficiency of the PDP and avoid the problems associated with the phosphor materials.

In a preferred embodiment, the plasma display panel (PDP) disclosed in the present invention includes a rear plate, a front plate spaced apart and positioned in parallel with the rear plate, and a plurality of barrier ribs positioned in the space between the rear plate and the front plate to define a plurality of discharge space groups. Each discharge space group includes a first discharge space, a second discharge space, and a third discharge space. Each discharge space is filled with the different discharge gases including a first, a second, and a third discharge gas for respectively emitting of one of three primary colors. The rear plate of the PDP has a reflecting layer to reflect the light and prevent the light from penetrating through the rear plate so as to increase the luminescent efficiency of the PDP.

It is an advantage of the present invention that it provides a plasma display panel(PDP) with greater luminescent efficiency. As well, the problems associated with phosphor materials are prevented occurring in the PDP of the present invention. As a result, the life time of the PDP is extended.

These and other objectives of the present invention will no doubt become obvious to those of ordinary skill in the art after having read the following detailed description of the preferred embodiment, which is illustrated in the various figures and drawings.

DETAILED DESCRIPTION

Figure 1:
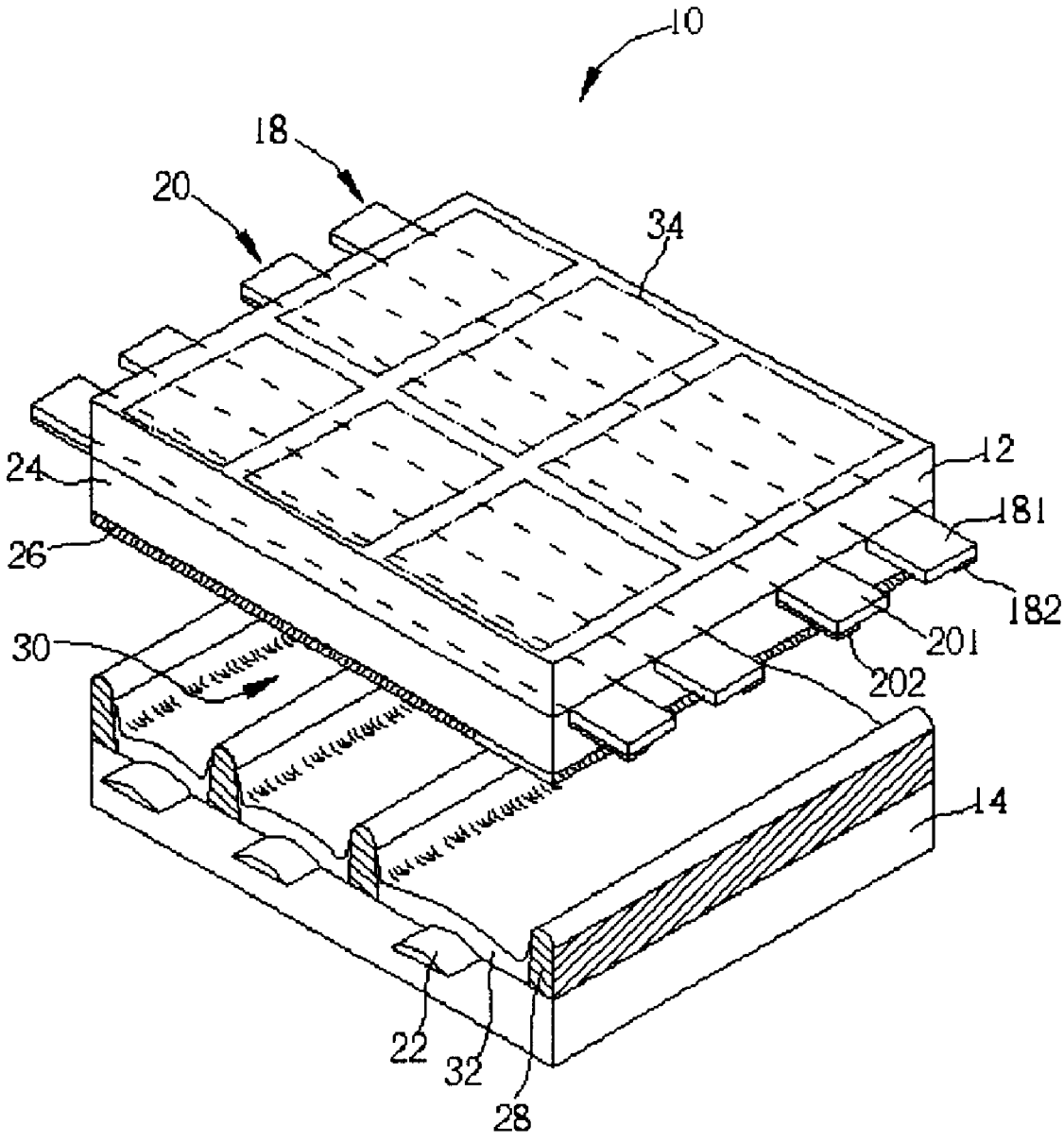
Fig. 1 Prior art
FIG. 1 is a perspective view of a full-color PDP according to the prior art.
Figure 2:
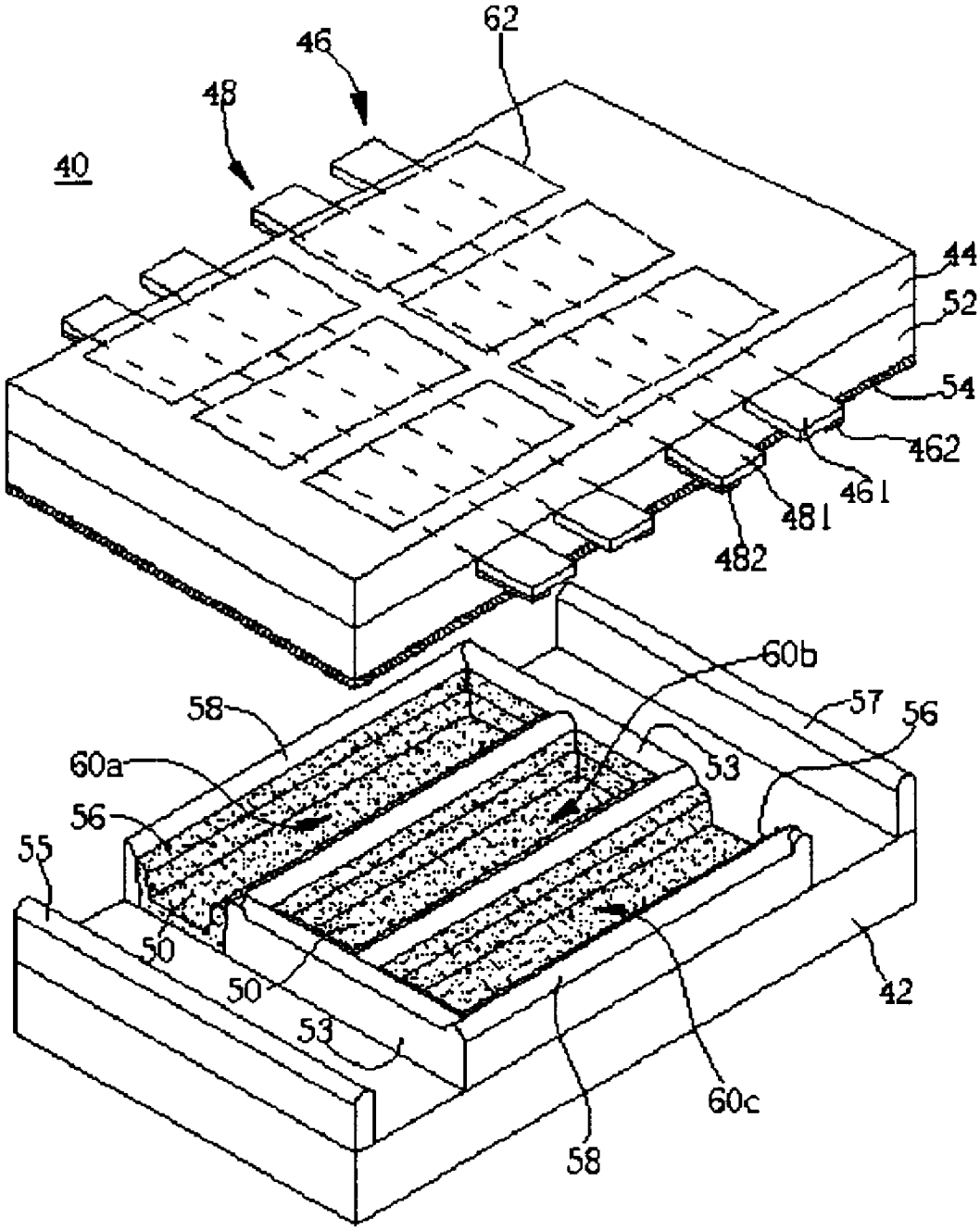
FIG. 2 is a perspective view showing a first embodiment of a full-color PDP according to the present invention.

Please refer to FIG. 2. FIG. 2 is a perspective view of a full-color PDP 40 according to the present invention. The full-color PDP 40 includes a rear plate 42, and a front plate 44 positioned parallel to and spaced apart from the rear plate 42 to form a space between the front plate 44 and the rear plate 42. A plurality of first electrodes 46 and second electrodes 48 are on the front plate 44 and positioned in parallel to each other. Each of the first electrodes 46 and the second electrodes 48 comprises a maintaining electrode 461, 481, and an auxiliary electrode 462, 482. The auxiliary electrode 462, 482 is narrower than the maintaining electrode 461, 481. The maintaining electrodes 461, 481 are transparent and made of indium tin oxide (ITO) or tin oxide (SnO). The auxiliary electrodes 462, 482 are made of a Cr/Cu/Cr metal alloy or silver (Ag), and have good conductivity so as to increase the conductivity of both the first electrode 46 and the second electrode 48. A plurality of third electrodes 50 are further formed on the back substrate 42. The third electrodes 50 are address electrodes, and are positioned orthogonal to the first electrodes 46 and the second electrodes 48.

The front plate 44 further includes a dielectric layer 52 covering the surfaces of the front plate 44, the first electrodes 46, and the second electrodes 48. A protective layer 54 further covers the dielectric layer 52. The rear plate 42 includes a plurality of barrier ribs 58 and air-lock ribs 53. Each barrier rib 58 is positioned in parallel to each other on the rear plate 42. The barrier ribs will co-operate with the air-lock ribs 53 to seal the front plate 44 and rear plate 42. Then, a plurality of discharge space groups are defined between the front plate 44 and the rear plate 42 of the full-color PDP 40. Each discharge space group contains a first discharge space 60*a*, a second discharge space 60*b*, and a third discharge space 60*c*.

The rear plate 42 contains a metal reflecting layer 56 formed on the surface of the rear plate 42 corresponding to each first discharge space 60*a*, second discharge space 60*b*, and third discharge space 60*c* of the rear plate 42. The metal reflecting layer can be formed by a sputtering method. The metal reflecting layer 56 can further surrounds the side walls of the ribs in each discharge space 60*a*~60*c* to reflect the light produced in each discharge space group and to prevent the light from passing through the rear plate 42. As a result, the contrast of the PDP 40 is increased so as to enhance the luminescent efficiency of the PDP 40. Furthermore, the metal reflecting layer 56 can function as the third electrode 50 for inputting data in each first discharge space 60*a*, second discharge space 60*b*, and third discharge space 60*c*. The metal reflecting layer 56 may be made of silver (Ag), aluminum (Al), copper (Cu), or chromium (Cr). Each discharge space 60 contains a plurality of display units 62, each display unit 62 is an area defined by one of the first electrodes 46, one of the second electrodes 48, and one of the third electrodes 50. Hence, all display units 62 are arranged as a matrix shape within the discharge spaces 60.

No phosphor material is used in the full-color PDP 40. There are several kinds of discharge gases are used as the luminescent medium. The full-color PDP 40 contains a first discharge gas, a second discharge gas, and a third discharge gas (all not shown) for respectively filling in the first discharge spaces 60*a*, second discharge spaces 60*b*, and third discharge spaces 60*c* to emit the primary colors of red, green, and blue light. A mixture of neon (Ne) and argon (Ar) is used to emit red light, a mixture of xenon (Xe) and oxygen ($O_2$) is used to emit green light, and a mixture of krypton (Kr) and neon (Ne) is used to emit blue light.

When an initiating voltage is applied between the first electrode 46 and the third electrode 50, the discharged gas is ionized by the electric field between the first electrode 46 and the third electrode 50 to form wall charges. Then, the first electrode 46 and the second electrode 48 are used to drive the plasma formed in the display units 62 for causing continuous emission of visible light. Thus, cooperating with the metal reflecting layer, the light will transmit through the front plate 44 to the user's eyes.

The full-color PDP 40 uses the discharge gases, rather than the phosphor materials, as a luminescent medium. Usually the rear plate 42 is transparent, and the phosphor materials are white so as to block the transmittance of the light. Without the phosphor material, the light produced by the discharge gas will pass through the transparent rear plate 42 to cause a "light leakage" problem. Therefore, a reflecting layer 56 is formed on the rear plate 42 to reflect the light of the PDP 40 and to prevent it from passing through the rear plate 42 in the present invention. At the same time, the contrast of the PDP 40 is increased.

Figure 3:
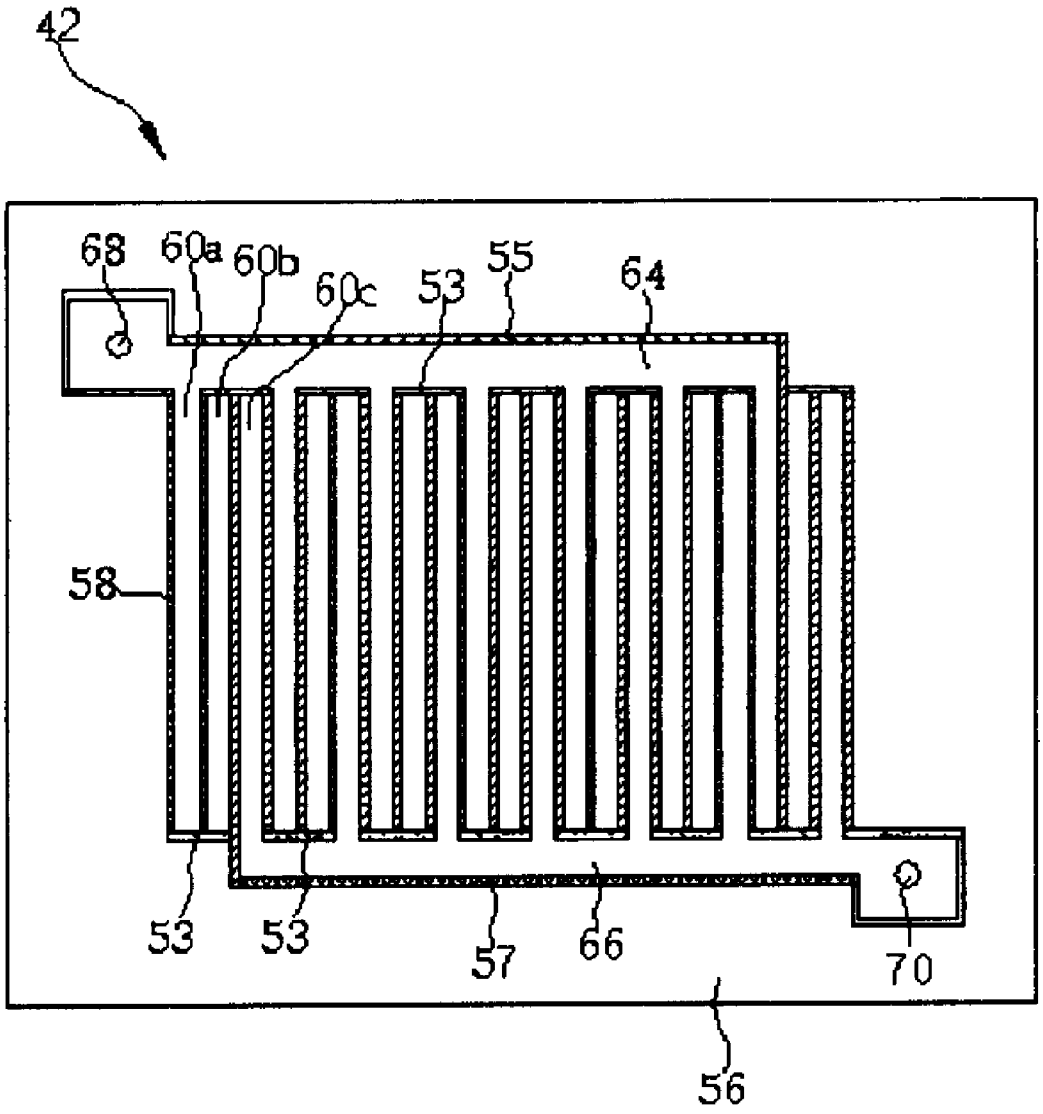
FIG. 3 is a top-view of barrier ribs of the full-color PDP shown in FIG. 2.

Please refer to FIG. 3. FIG. 3 is a top view of the barrier ribs 58 and discharge spaces 60 shown in FIG. 2. A plurality of upper openings are formed on an upper side of the first discharge spaces 60*a*, the second discharge spaces 60*b*, and the third discharge spaces 60*c*. Besides, a plurality of lower openings are formed on a lower side of the first discharge spaces 60*a*, the second discharge spaces 60*b*, and the third discharge spaces 60*c*. Along both the upper side and the lower side of the plurality of discharge space groups, the air-locking ribs 53 are positioned on the rear plate 42. The air-locking ribs 53 are perpendicular to the barrier ribs 58 and seal the lower opening of the first discharge space 60*a*, both the upper and lower openings of the second discharge space 60*b*, and the upper opening of the third discharge space 60*c*.

As shown in FIG. 3, the rear plate 42 includes a first wall 55 positioned in parallel to the air-lock rib 53 and located on the upper side of the discharge space groups. A first channel 64 is defined by the first wall 55 and the neighboring air-locking ribs 53, and connected to the first discharge spaces 60*a* by the upper openings. Also, a second wall 57 is further formed on the rear plate 42, positioned in parallel with the air-lock ribs 53, and located on the lower side of the discharge space groups. A second channel 66 is defined by the second wall 57 and the neighboring air-locking ribs 53, and connected to the third discharge spaces 60*c* through each of the lower openings. Therefore, the first channel 64 enables the first discharge gas to circulate around all the first discharge spaces 60*a*, and the second channel 66 enables the third discharge gas to circulate around all of the third discharge spaces 60*c*. Besides, the second discharge gas is trapped within the second discharge spaces 60*b*. The PDP 40 also has a first vent 68 communicating with the first channel 64, and a second vent 70 communicating with the second channel 66. The original existing gas is evacuated through the first vent 68, followed by filling the first discharge gas into the first channel 64. Similarly, the original existing gas is evacuated through the second vent 70, followed by filling the third discharge gas into the second channel 66.

Please refer to FIG. 4 to FIG. 7. FIG. 4 to FIG. 7 are cross-sectional diagrams of the manufacturing method of the full-color PDP shown in FIG. 2. The method for manufacturing the full-color PDP 40 according to the present invention begins by providing a front plate 44 and a rear plate 42, followed by forming a plurality of parallel barrier ribs 58, a plurality of air-lock ribs 53, a first wall 55, and a second wall 57 on the rear plate 42. A metal reflecting layer 56 is then formed on (a) the side walls of each rib 58, (b) the surface of the air-lock rib 53, and (c) the surface of the rear plate 42 surrounded by each barrier rib 58 and air-lock rib 53. Finally, the front plate 44 and rear plate 42 are sealed together, and the discharge gases are filled in the space between the rear plate 42 and front plate 44.

Figure 4:
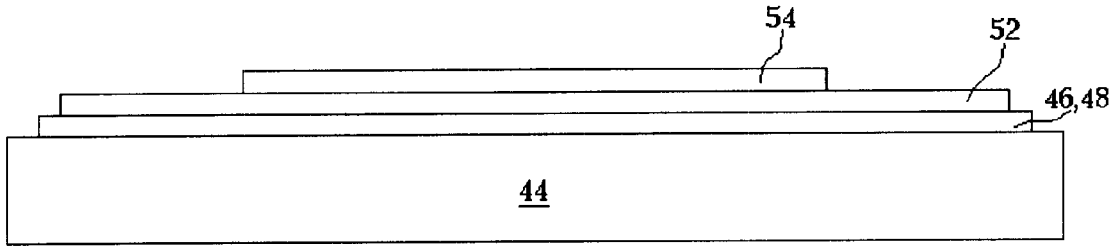
FIG. 4 to FIG. 7 are the cross-sectional diagrams of manufacturing methods of the full-color PDP shown in FIG. 2.

Referring to FIG. 4, a plurality of first electrodes 46 and second electrodes 48 are formed in parallel on the front plate 44. A dielectric layer 52, made of glass slurry, covers the surfaces of the front plate 44, the first electrodes 46, and the second electrodes 48. Next, a first protective layer 54, made of MgO, is formed to cover the dielectric layer 52.

Figure 5:
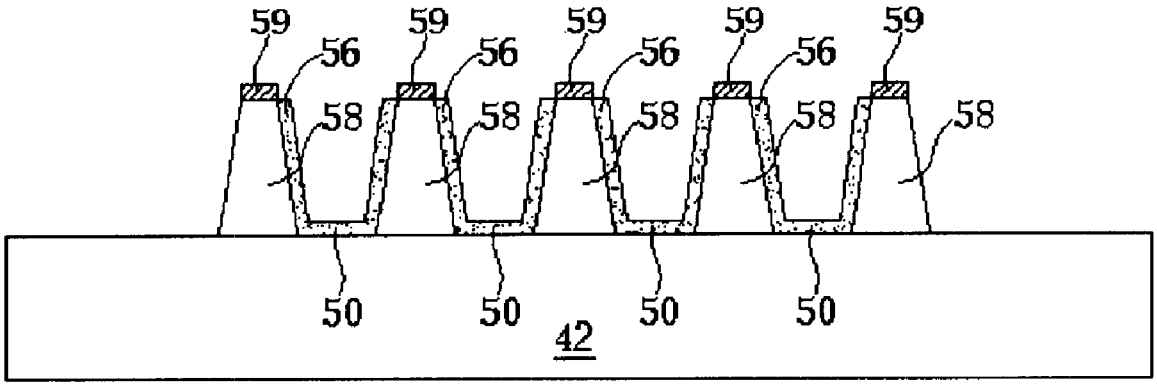

As shown in FIG. 5, according to the design shown in FIG. 3, the barrier ribs 58, the air-locking ribs 53, the first wall 55, and the second wall 57 are formed on the rear plate 42, respectively. Generally, the methods of forming the barrier ribs 58 include the screen printing, sand blasting, imbedding, etc. The quality of the sand blasting method is high. The process of the sand blasting method includes (a) the barrier rib materials formation, (b) the photoresist materials formation, (c) a photolithographic process, (d) a sand-blasting process, and (e) a process of the photoresist materials removing and the rib sintering. After all the barrier ribs 58 are manufactured, a metal reflecting layer 56 is coated on the side wall of each barrier rib 58, the surface of the air-lock rib 53, and the surface of the rear plate 42 surrounded by each rib 58 and air-lock rib 53. The metal reflecting layer 56 is also used as the third electrode 50 for inputting data. Finally, a sealing material 59 is coated on the barrier ribs 58.

Figure 6:
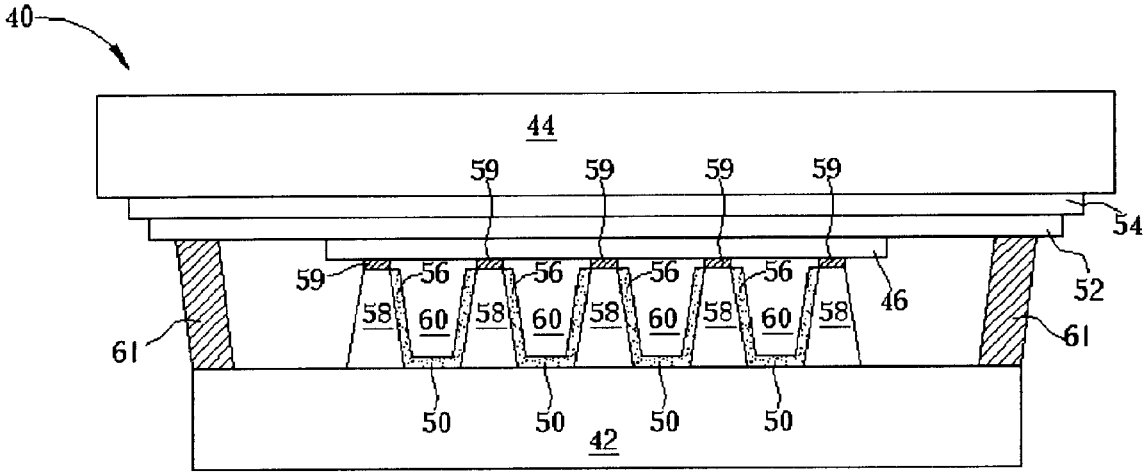

As shown in FIG. 6, another sealing material 61 is coated on the periphery of the rear plate 42 for sealing the front plate 44 onto the rear plate 42 so as to substantially complete the PDP 40.

Figure 7:
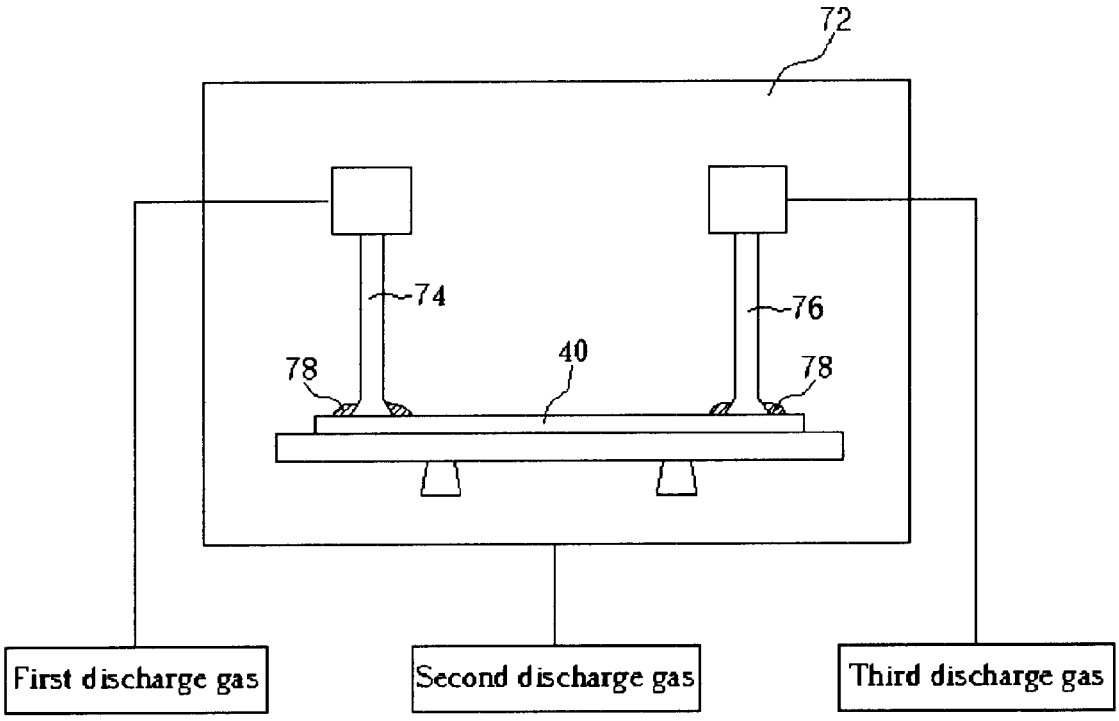

As shown in FIG. 7, the PDP 40 is loaded in an enclosed chamber 72 for filling the appropriate discharge gases into each discharge spaces 60. First, the air is extracted out of the chamber 72, and filling the chamber 72 with the second discharge gas. Therefore, the second discharging gas will fulfill all discharging space 60 of the PDP 40. Then, the temperature of the chamber 72 is increased above the softening point temperature (Ts) of the sealing materials 59, 61 for sealing the front plate 44 and the rear plate 42. In the same time, all the second discharge spaces 60*b* are sealed. Further, the temperature of the chamber 72 is are filled in the space between the rear plate 42 and front plate 44.

Referring to FIG. 4, a plurality of first electrodes 46 and second electrodes 48 are formed in parallel on the front plate 44. A dielectric layer 52, made of glass slurry, covers the surfaces of the front plate 44, the first electrodes 46, and the second electrodes 48. Next, a first protective layer 54, made of MgO, is formed to cover the dielectric layer 52.

As shown in FIG. 5, according to the design shown in FIG. 3, the barrier ribs 58, the air-locking ribs 53, the first wall 55, and the second wall 57 are formed on the rear plate 42, respectively. Generally, the methods of forming the barrier ribs 58 include the screen printing, sand blasting, imbedding, etc. The quality of the sand blasting method is high. The process of the sand blasting method includes (a) the barrier rib materials formation, (b) the photoresist materials formation, (c) a photolithographic process, (d) a sand-blasting process, and (e) a process of the photoresist materials removing and the rib sintering. After all the barrier ribs 58 are manufactured, a metal reflecting layer 56 is coated on the side wall of each barrier rib 58, the surface of the air-lock rib 53, and the surface of the rear plate 42 surrounded by each rib 58 and air-lock rib 53. The metal reflecting layer 56 is also used as the third electrode 50 for inputting data. Finally, a sealing material 59 is coated on the barrier ribs 58.

As shown in FIG. 6, another sealing material 61 is coated on the periphery of the rear plate 42 for sealing the front plate 44 onto the rear plate 42 so as to substantially complete the PDP 40.

As shown in FIG. 7, the PDP 40 is loaded in an enclosed chamber 72 for filling the appropriate discharge gases into each discharge spaces 60. First, the air is extracted out of the chamber 72, and filling the chamber 72 with the second discharge gas. Therefore, the second discharging gas will fulfill all discharging space 60 of the PDP 40. Then, the temperature of the chamber 72 is increased above the softening point temperature (Ts) of the sealing materials 59, 61 for sealing the front plate 44 and the rear plate 42. In the same time, all the second discharge spaces 60*b* are sealed. Further, the temperature of the chamber 72 is lowered than the softening point temperature (Ts) of the sealing materials 59, 61. The above sealing process bonds the front plate 44 and the rear plate 42 together via the sealing materials 59, 61 to trap the second discharge gas within each discharge space 60. Next, two tubes 74, 76 are respectively connected to the first vent 68 and the second vent 70 by using another sealing material 78. The second discharge gas within the first channel 64 and the first discharge spaces 60*a* is extracted through the tube 74 of the first vent 68. The first discharge gas is then loaded into the first channel 64 and the first discharge spaces 60*a*. In the same manner, the third discharge gas within the second channel 66 and the third discharge spaces 60*c* is extracted through the tube 76 of the second vent 70. The third discharge gas is then loaded into the second channel 66 and the third discharge spaces 60*c*. Finally, a tip-off process of the tubes 74, 76 is applied by heating so as to prevent leaking of the discharge gases from the vents 68, 70. The PDP 40 is then taken out of the chamber 72.

The completed PDP 40 has the first discharge gas filled in the first discharge spaces 60*a*, the second discharge gas filled in the second discharge spaces 60*b*, and the third discharge gas filled in the third discharge spaces 60*c*. After applying an initiating voltage, the first discharge gas, the second discharge gas, and the third discharge gas will emit red, green, and blue light, respectively. All light will be reflected by the metal reflecting layer 56, and pass through the front plate 44 to the user.

Figure 8:
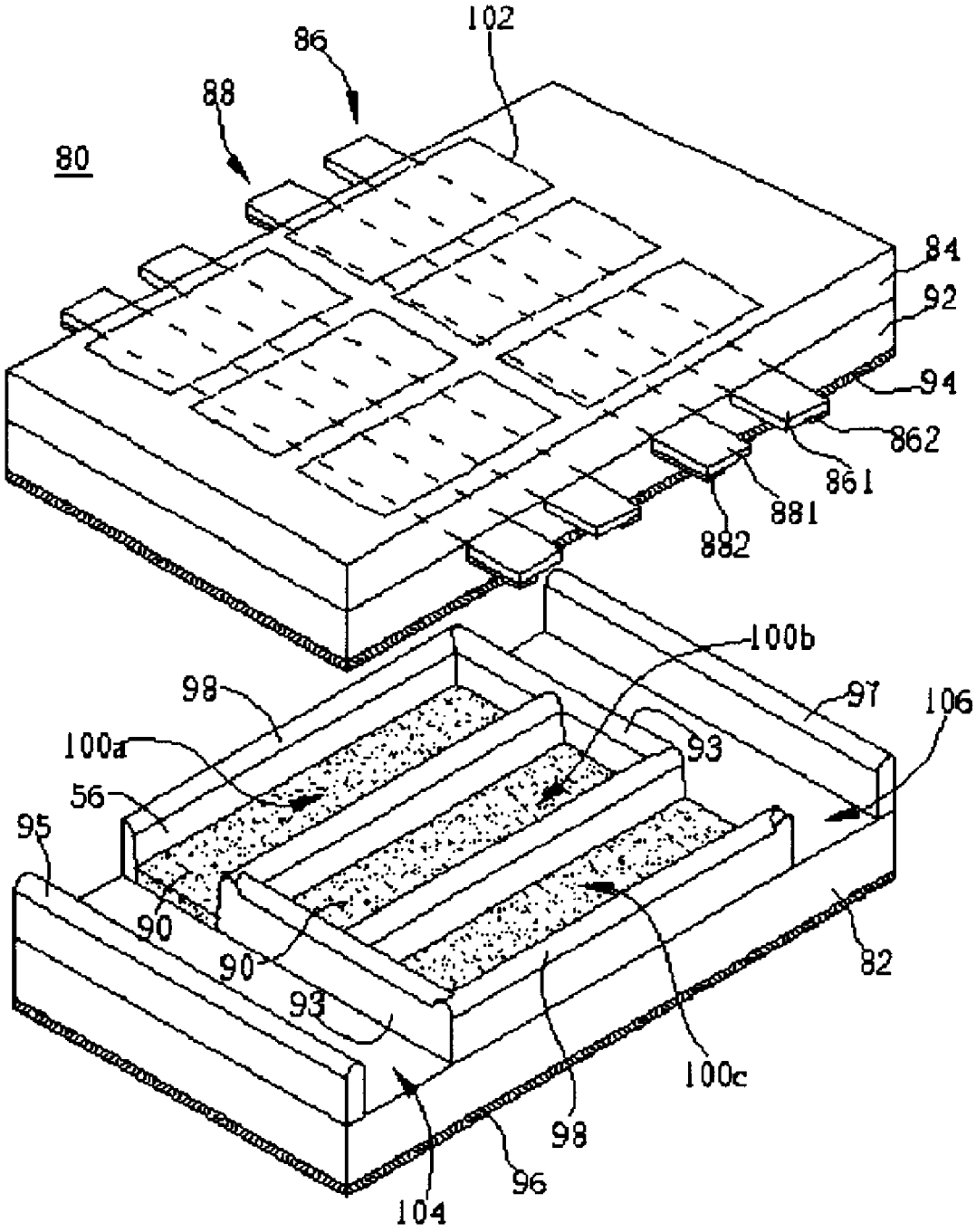
FIG. 8 is a perspective view showing a second embodiment of a full-color PDP according to the present method.

FIG. 8 is a perspective view showing a second embodiment of a full-color PDP 80 according to the present method. The PDP 80 includes a rear plate 82, a front plate 84 positioned parallel to the rear plate 82, and a plurality of first electrodes 86 and second electrodes 88 positioned in parallel to each other on the front plate 84. Each of the first electrodes 86 and the second electrodes 88 has a maintaining electrode 861, 881, and an auxiliary electrode 862, 882. The auxiliary electrodes 862, 882 are narrower than the maintaining electrodes 861, 881.

The major difference between the PDP 80 and the PDP 40 is the position of the metal reflecting layer 56. In the PDP 80, the metal reflecting layer 56 is formed on the back of the rear plate 82, rather than on the plane facing the front plate 84. Further, a plurality of third electrode 90 is formed on the plane facing the front plate 84. The metal reflecting layer can be composed of silver (Ag), aluminum (Al), copper (Cu), chromium (Cr), mercury (Hg), or a metal oxide such as $Al_2O_3$.

The present invention uses different discharge gases to emit variant colors of light. As well, a reflecting layer is coated on the surface of the rear plate to reflect the light emitted by each discharge gas. The reflecting layer prevents the light passing through the rear plate and increases the contrast of the PDP. Therefore, the PDP of the present invention has greater luminescent efficiency. Besides, no phosphor material is used in the PDP of the present invention, the problems associated with phosphor materials can be avoided. The life time of the PDP is extended.

In comparison to the prior art, the PDP of the present invention has the first discharge gas filling the first discharge spaces, the second discharge gas filling the second discharge spaces, and the third discharge gas filling the third discharge spaces. The PDP does not use the phosphor materials, but use different discharge gases as the luminescent medium to avoid the problems associated with phosphor materials, as well as to increase the efficiency life of the PDP.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A plasma display panel (PDP) comprising:

a rear plate containing a first plane and a second plane opposing to the first plane;

a front plate positioned parallel to and spaced apart from the rear plate, the front plate facing the first plane of the rear plate, and forming a space between the rear plate and the front plate;

a plurality of barrier ribs positioned within the space for defining a plurality of discharge space groups, each group comprising a first discharge space, a second discharge space, and a third discharge space, each discharge space comprising an upper opening on an upper side of the discharge space, and a lower opening on a lower side of the discharge space;

a plurality of air-locking ribs positioned within the space to seal the lower opening of the first discharge space, the upper opening and lower opening of the second discharge space, and the upper opening of the third discharge space;

a reflecting layer coated on the rear plate corresponding to the first, second and third discharge space;

a first wall positioned on an upper side of the plurality of the discharge space groups, the first wall and the neighboring air-locking ribs defining a first channel accessible through each of the upper openings of the first discharge spaces;

a second wall positioned on a lower side of the plurality of the discharge space groups, the second wall and the neighboring air-locking ribs defining a second channel which is accessible through each of the lower openings of the third discharge spaces; and a first discharge gas, a second discharge gas, and a third discharge gas filling the first discharge space, the second discharge space, and the third discharge space, each discharge gas being used to emit a specific colored light.

2. The PDP of claim 1 wherein the reflecting layer is composed of metal.

3. The PDP of claim 2 wherein the reflecting layer is formed on the first plane of the rear plate and used as address electrodes of the first, second, and third discharge spaces.

4. The PDP of claim 3 wherein the reflecting layer is positioned around the side walls of the barrier ribs within the first, second, and third discharge spaces to reflect the light produced by each discharge gas, and the reflecting layer is used to prevent the light from passing through the rear plate so as to increase the contrast of the PDP.

5. The PDP of claim 1 wherein each of the first discharge spaces is connected with the first channel to enable the first discharge gas to circulate around all the first discharge spaces, and each of the third discharge spaces is connected with the second channel to enable the third discharge gas to circulate around all the third discharge spaces, and the second discharge gas is trapped within each of the second discharge spaces.

6. The PDP of claim 5 wherein the plasma display panel further comprises a vent positioned in the first channel to deliver the first discharge gas to the first channel, and another vent positioned in the second channel to deliver the third discharge gas to the second channel.

7. The PDP of claim 1 wherein the discharge gases comprise a discharge gas made of neon (Ne) and argon (Ar) for emitting red light, a discharge gas made of xenon (Xe) and oxygen ($O_2$) for emitting green light, and a discharge gas made of krypton (Kr) and neon (Ne) for emitting blue light.

8. The PDP of claim 1 wherein the reflecting layer is formed on the second plane of the rear plate.

9. The PDP of claim 8 wherein the rear plate includes a plurality of metal layers, positioned on the first plane which corresponding to the positions of the first, second, and third discharge space, the metal layers are used address electrodes of the first, second, and third discharge space.

10. A method for forming a plasma display panel (PDP), the PDP comprising a rear plate and a front plate, the method comprising:

forming a plurality of parallel barrier ribs, a plurality of air-lock ribs, a first channel wall, and a second channel wall on the rear plate;

forming a reflecting layer on the rear plate;

in an enclosed chamber, sealing the front plate and the rear plate to form a space therebetween, the enclosed chamber filled with a second discharge gas so as to fill the first discharge space, the second discharge space, the third discharge space, the first channel, and the second channel with the second discharge gas;

extracting the second discharge gas from the first channel and from the first discharge space via the first channel, and filling both the first channel and the first discharge space with a first discharge gas; and extracting the second discharge gas from the second channel and from the third discharge space via the second channel, and filling both the second channel and the third discharge space with a third discharge gas.

11. The method of claim 10 wherein the rear plate includes a first plane and a second plane, the barrier ribs and the reflecting layer are formed on the first plane.

12. The method of claim 10 wherein the back plate includes a first plane and a second plane, and the barrier rib is formed on the first plane while the reflecting layer is formed on the second plane.

* * * * *